United States Patent [19]

Carson et al.

[11] Patent Number: 4,482,369

[45] Date of Patent: Nov. 13, 1984

[54] PROCESS FOR PRODUCING A HYDROGEN-RICH GAS STREAM FROM THE EFFLUENT OF A CATALYTIC HYDROCARBON CONVERSION REACTION ZONE

[75] Inventors: Don B. Carson, Mt. Prospect; Robert B. James, Jr., Northbrook, both of Ill.

[73] Assignee: UOP Inc., Des Plaines, Ill.

[21] Appl. No.: 493,180

[22] Filed: May 10, 1983

[51] Int. Cl.[3] ..... F25J 3/02

[52] U.S. Cl. ..... 62/18; 62/23; 62/39

[58] Field of Search ..... 62/38, 39, 9, 11, 18, 62/23, 17

[56] References Cited

U.S. PATENT DOCUMENTS

| | | | |
|---|---|---|---|
| 3,431,195 | 3/1969 | Storch et al. | 208/101 |
| 3,516,924 | 6/1970 | Forbes | 208/65 |
| 3,520,799 | 7/1970 | Forbes | 208/101 |
| 3,520,800 | 7/1970 | Forbes | 208/101 |
| 3,553,972 | 1/1971 | Markbreiter et al. | 62/39 |
| 3,882,014 | 5/1975 | Monday et al. | 208/134 |
| 4,212,726 | 7/1980 | Mayes | 208/101 |
| 4,356,014 | 10/1982 | Higgins | 62/39 |
| 4,364,820 | 12/1982 | DeGraff et al. | 208/101 |
| 4,374,726 | 2/1983 | Schmelzer et al. | 208/101 |

*Primary Examiner*—Frank Sever

*Attorney, Agent, or Firm*—James R. Hoatson, Jr.; John F. Spears, Jr.; William H. Page, II

[57] ABSTRACT

A process for the production of a hydrogen-rich gas stream from the effluent of a catalytic hydrocarbon conversion reaction zone is disclosed. A hydrogen-containing vapor phase is recovered from the effluent and subjected to cooling in order to produce a hydrogen-rich gas stream. The resulting hydrogen-rich gas stream is expanded to provide the medium used in cooling the hydrogen-containing vapor phase.

10 Claims, 1 Drawing Figure

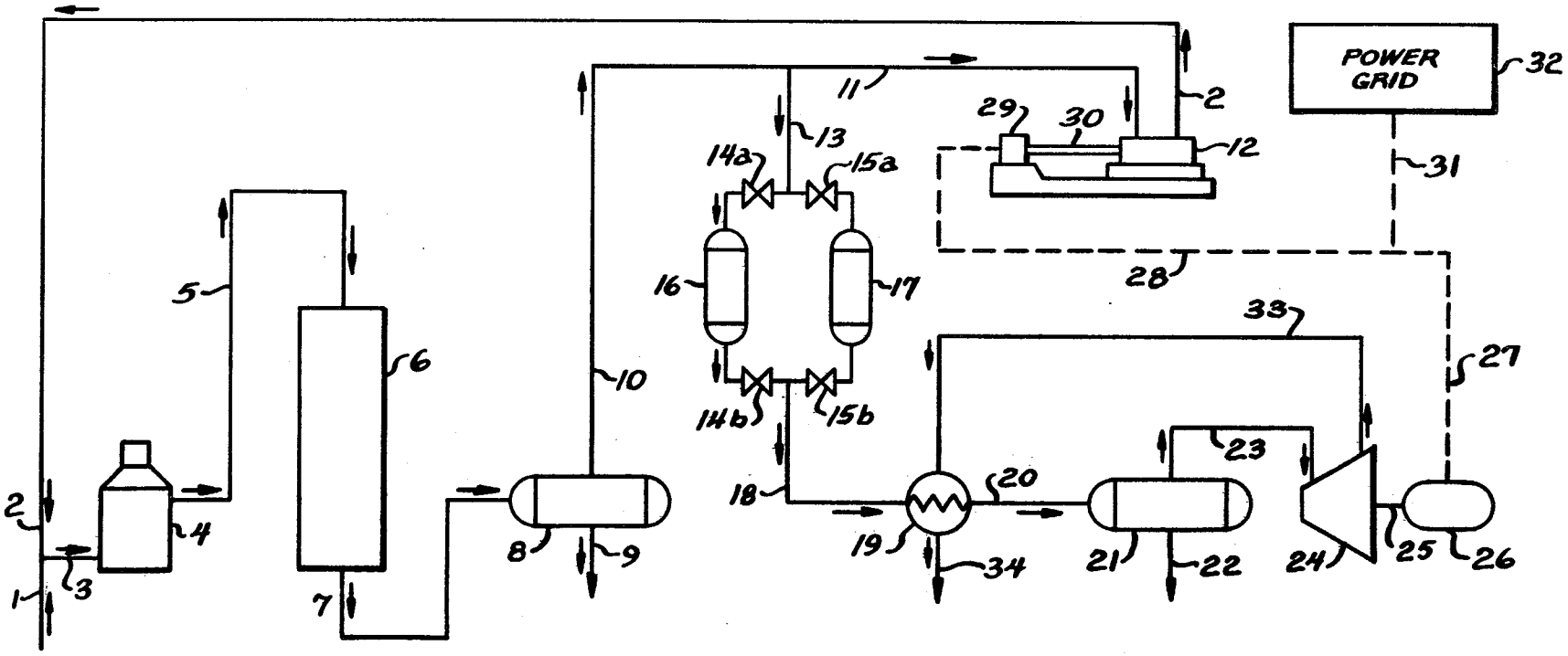
POWER GRID
32
31
27
26
25
24
33
23
22
21
20
34
19
18
28
12
2
30
29
11
13
15a
15b
14a
14b
17
16
10
9
8
6
7
5
4
3
2
1

PROCESS FOR PRODUCING A HYDROGEN-RICH GAS STREAM FROM THE EFFLUENT OF A CATALYTIC HYDROCARBON CONVERSION REACTION ZONE

BACKGROUND OF THE INVENTION

The present invention is directed toward an improved method for recovering a hydrogen-rich gas stream from a hydrogen and hydrocarbon effluent of a catalytic hydrocarbon conversion zone. More particularly the described inventive technique is adaptable for utilization in catalytic hydrocarbon conversion reactions which result in a net production of hydrogen.

Various types of catalytic hydrocarbon conversion reaction systems have found widespread utilization throughout the petroleum and petrochemical industries for effecting the conversion of hydrocarbons to a multitudinous number of products. The reactions employed in such systems are either exothermic or endothermic, and of more importance to the present invention, often result in either the net production of hydrogen or the net consumption of hydrogen. Such reaction systems, as applied to petroleum refining, have been employed to effect numerous hydrocarbon conversion reactions including those which predominate in catalytic reforming, ethylbenzene dehydrogenation to styrene, propane and butane dehydrogenation, etc.

Petroleum refineries and petrochemical complexes customarily comprise numerous reaction systems. Some systems will be net consumers of hydrogen while other systems within the refinery or petrochemical complex may result in the net production of hydrogen. Because hydrogen is a relatively expensive item, it has become the practice within the art of hydrocarbon conversion to supply hydrogen from reaction systems which result in the net production of hydrogen to reaction systems which are net consumers of hydrogen. Occasionally the net hydrogen being passed to the net hydrogen-consuming reaction systems must be of high purity due to the reaction conditions and/or the catalyst employed in the systems. Such a situation may require treatment of the hydrogen from the net hydrogen-producing reaction systems to remove hydrogen sulfide, light hydrocarbons, etc., from the net hydrogen stream.

Alternatively, the hydrogen balance for the petroleum refinery or petrochemical complex may result in excess hydrogen, i.e., the net hydrogen-producing reaction systems produce more hydrogen than is necessary for the net hydrogen-consuming reaction systems. In such an event the excess hydrogen may be sent to the petroleum refinery or petrochemical complex fuel system. However, because the excess hydrogen often has admixed therewith valuable components, such as $C_3+$ hydrocarbons, it is frequently desirable to treat the excess hydrogen to recover these components prior to its passage to fuel.

Typical of the net hydrogen-producing hydrocarbon reaction systems are catalytic reforming, catalytic dehydrogenation of alkyl-aromatics and catalytic dehydrogenation of paraffins. Commonly employed net hydrogen-consuming reaction systems are hydrotreating, hydrocracking and catalytic hydrogenation. Of the above mentioned net hydrogen-producing and consuming hydrocarbon reaction systems, catalytic reforming ranks as one of the most widely employed. By virtue of its wide application and its utilization as a primary source of hydrogen for the net hydrogen-consuming reaction systems, catalytic reforming has become well known in the art of hydrocarbon conversion reaction systems. Accordingly the following discussion of the invention will be in reference to its application to a catalytic reforming reaction system. However, the following discussion should not be considered as unduly limiting the broad scope of the invention which has wide application in many hydrocarbon conversion reaction systems. Those having ordinary skill in the art will well recognize the broad application of the present invention and the following will enable them to apply the invention in all its multitudinous embodiments.

It is well known that high quality petroleum products in the gasoline boiling range including, for example, aromatic hydrocarbons such as benzene, toluene and the xylenes, are produced by the catalytic reforming process wherein a naphtha fraction is passed to a reaction zone wherein it is contacted with a platinum-containing catalyst in the presence of hydrogen. Generally, the catalytic reforming reaction zone effluent, comprising gasoline boiling range hydrocarbons and hydrogen, is passed to a vapor-liquid equilibrium separation zone and is therein separated into a hydrogen-containing vapor phase and an unstabilized hydrocarbon liquid phase. A portion of the hydrogen-containing vapor phase may be recycled to the reaction zone. The remaining hydrogen-containing vapor phase is available for use either by the net hydrogen-consuming processes or as fuel for the petroleum refinery or petrochemical complex fuel system. While a considerable portion of the hydrogen-containing vapor phase is required for recycle purposes, a substantial net excess is available for other uses.

Because the dehydrogenation of naphthenic hydrocarbons is one of the predominant reactions of the reforming process, substantial amounts of hydrogen are generated within the catalytic reforming reaction zone. Accordingly a net excess of hydrogen is available for use as fuel or for use in a net hydrogen-consuming process such as the hydrotreating of sulfur-containing petroleum feedstocks. However, catalytic reforming also involves a hydrocracking function among the products of which are relatively low molecular weight hydrocarbons including methane, ethane, propane, butanes and the pentanes, substantial amounts of which appear in the hydrogen-containing vapor phase separated from the reforming reaction zone effluent. These normally gaseous hydrocarbons have the effect of lowering the hydrogen purity of the hydrogen-containing vapor phase to the extent that purification is often required before the hydrogen is suitable for other uses. Moreover, if the net excess hydrogen is intended for use as fuel in the refinery or petrochemical complex fuel system, it is frequently desirable to maximize the recovery of $C_3+$ hydrocarbons which are valuable as feedstock for other processes. It is therefore advantageous to devise a method of purifying the hydrogen-containing vapor phase to produce a hydrogen-rich gas stream and to recover valuable components such as $C_3+$ hydrocarbons.

OBJECTS AND EMBODIMENTS

A principal object of our invention is an improved process for producing a hydrogen-rich gas stream from the effluent of a catalytic hydrocarbon conversion reaction zone. A corollary objective is to recover energy from the hydrogen-rich gas stream thereby increasing the efficiency of the hydrocarbon conversion reaction system. Other objects in applying the invention specifically to catalytic reforming involve increased recovery of $C_3$+ hydrocarbons for further advantageous use. Accordingly a broad embodiment of the present invention is directed toward a process for producing a hydrogen-rich gas stream by treating a hydrogen and hydrocarbon effluent from a catalytic hydrocarbon conversion reaction zone comprising the steps of: (a) passing said effluent to a first vapor-liquid equilibrium zone, recovering therefrom a hydrogen-containing vapor phase and recycling a first portion thereof to said reaction zone; (b) drying at least a second portion of the hydrogen-containing vapor phase and thereafter cooling the dried portion by indirect heat exchange with a hereinafter defined hydrogen-rich gas stream; (c) passing the dried, cooled portion of the hydrogen-containing vapor phase to a second vapor-liquid equilibrium separation zone to produce a liquid stream comprising light hydrocarbons and a hydrogen-rich gas stream; (d) expanding at least a portion of the hydrogen-rich gas stream and thereafter subjecting it to indirect heat exchange with the dried portion of the hydrogen-containing vapor phase pursuant to step (b) above; and, (e) recovering the heat exchanged hydrogen-rich gas stream.

In an alternative and more specific embodiment, the present invention provides a process for producing a hydrogen-rich gas stream by treating a hydrogen and hydrocarbon effluent from a catalytic reforming reaction zone comprising the steps of: (a) passing said effluent to a first vapor-liquid equilibrium zone and recovering therefrom a hydrogen-containing vapor phase; (b) subjecting a first portion of the hydrogen-containing vapor phase to compression and recycling at least part of the compressed first portion to the catalytic reforming reaction zone; (c) drying a second portion of the hydrogen-containing vapor phase and thereafter cooling the dried portion by indirect heat exchange with a hereinafter defined hydrogen-rich gas stream; (d) passing the dried, cooled portion of the hydrogen-containing vapor phase to a second vapor-liquid equilibrium separation zone to produce a liquid stream comprising light hydrocarbons and a hydrogen-rich gas stream; (e) subjecting at least a portion of the hydrogen-rich gas stream to an expansion and thereafter subjecting it to indirect heat exchange with the dried second portion of the hydrogen-containing vapor phase pursuant to step (c) above, and effecting the compression in step (b) above at least in part with energy resulting from said expansion of the portion of hydrogen-rich gas stream; and, (f) recovering the heat exchanged hydrogen-rich gas stream.

These, as well as other objects and embodiments will become evident from the following, more detailed description of the present invention.

INFORMATION DISCLOSURE

The prior art recognizes myriad process schemes for the obtention and purification of a hydrogen-rich gas stream from the effluent of hydrocarbon conversion reaction zones. U.S. Pat. No. 3,431,195, issued Mar. 4, 1969, discloses such a scheme. The hydrogen and hydrocarbon effluent of a catalytic reforming zone is first passed to a low pressure vapor-liquid equilibrium zone from which zone is derived a first hydrogen-containing vapor phase and a first unstabilized hydrocarbon liquid phase. The hydrogen-containing vapor phase is compressed and recontacted with at least a portion of the liquid phase and the resulting mixture is passed to a second high pressure vapor-liquid equilibrium zone. Because the second zone is maintained at a higher pressure, a new vapor-liquid equilibrium is established resulting in a hydrogen-rich gas phase and a second unstabilized hydrocarbon liquid phase. A portion of the hydrogen-rich vapor phase is recycled back to the catalytic reforming reaction zone with the balance of the hydrogen-rich vapor phase being recovered as a hydrogen-rich gas stream relatively free of $C_3$–$C_6$ hydrocarbons.

U.S. Pat. No. 3,516,924, issued June 23, 1970, discloses a more complex system. In this reference the reaction zone effluent from a catalytic reforming process is first separated in a vapor-liquid equilibrium zone to produce a hydrogen-containing vapor phase and an unstabilized liquid hydrocarbon phase. The two phases are again recontacted and again separated in a higher pressure vapor-liquid equilibrium zone. A first portion of the resulting hydrogen-rich vapor phase is recycled back to the catalytic reforming zone while the remaining portion of the hydrogen-rich vapor phase is passed to an absorber column in which stabilized reformate is utilized as the sponge oil. A high purity hydrogen gas stream is recovered from the absorption zone and the sponge oil, containing light hydrocarbons is recontacted with the hydrocarbon liquid phase from the first vapor-liquid equilibrium zone prior to the passage thereof to the second high pressure vapor-liquid equilibrium zone.

U.S. Pat. No. 3,520,800, issued July 14, 1980, discloses an alternative method of obtaining a hydrogen-rich gas stream from a catalytic reforming reaction zone effluent. As in the previously discussed methods, the reforming reaction zone effluent is passed to a first vapor-liquid equilibrium zone from which is obtained a first hydrogen-containing vapor phase and a first unstabilized hydrocarbon liquid phase. The hydrogen-containing vapor phase is compressed and recontacted with the hydrocarbon liquid phase. Thereafter the mixture is passed to a second vapor-liquid equilibrium zone maintained at a higher pressure than the first vapor-liquid equilibrium zone. A second hydrogen-containing vapor phase of higher hydrogen purity is recovered from the second vapor-liquid equilibrium zone with a portion thereof being recycled back to the catalytic reforming reaction zone. The remaining amount of the resulting hydrogen-containing vapor phase is passed to a cooler wherein the temperature of the phase is reduced at least 20° F. lower than the temperature maintained in the second vapor-liquid equilibrium zone. After cooling, the hydrogen phase is passed to a third vapor-liquid equilibrium zone from which a high purity hydrogen gas stream is recovered.

U.S. Pat. No. 3,520,799, issued July 14, 1970, discloses yet another method for obtaining a high purity hydrogen gas stream from a catalytic reforming reaction zone effluent. As in all the previous schemes, the reaction zone effluent is passed to a low pressure vapor-liquid equilibrium zone from which is produced a hydrogen-containing vapor phase and an unstabilized liquid hydrocarbon phase. After compression the hydrogen-containing vapor phase is recontacted with the unstabilized liquid hydrocarbon phase and the resulting mixture is passed to a high pressure vapor-liquid equilibrium zone. A second hydrogen-containing vapor phase is produced of higher purity than the hydrogen-containing vapor phase from the low pressure vapor-liquid equilibrium zone. A first portion of this higher purity hydrogen-containing vapor phase is recycled back to the catalytic reforming zone. The balance of the higher purity hydrogen-containing vapor phase is passed to an absorption zone where it is contacted with a lean sponge oil preferably comprising $C_6$+ hydrocarbons. A hydrogen-containing gas stream is removed from the absorber and after cooling passed to a third vapor-liquid equilibrium zone. The sponge oil, containing constituents absorbed from the higher purity hydrogen-containing vapor phase is removed from the absorption zone and is admixed with the unstabilized liquid hydrocarbon stream from the low pressure vapor-liquid equilibrium zone prior to the recontacting thereof with the compressed hydrogen-containing vapor phase. A stream of high purity hydrogen gas is removed from the third vapor-liquid equilibrium zone.

U.S. Pat. No. 3,882,014, issued May 6, 1975, discloses another method of obtaining a high purity hydrogen stream from the reaction zone effluent of a catalytic reforming process. The catalytic reforming reaction zone effluent is first passed to a vapor-liquid equilibrium zone from which is recovered an unstabilized liquid hydrocarbon stream and a hydrogen-containing vapor phase. After compression the hydrogen-containing vapor phase is passed to an absorption zone wherein it is contacted with a sponge oil comprising stabilized reformate. A high purity hydrogen gas stream is recovered from the absorption zone with one portion thereof being recycled back to the catalytic reforming reaction zone while the remainder is recovered for further use. A liquid stream is recovered from the absorption zone and admixed with the unstabilized liquid hydrocarbon stream from the vapor-liquid equilibrium zone. The admixture is then fractionated in a stabilizing column to produce the stabilized reformate, a first portion of which is utilized as the sponge oil in the absorption zone.

More recent, U.S. Pat. No. 4,212,726, issued July 15, 1980, discloses yet another variation of the previously described methods for recovering high purity hydrogen stream from catalytic reforming reaction zone effluents. In this reference the reaction zone effluent from the catalytic reforming process is passed to a first vapor-liquid equilibrium zone from which is recovered a first unstabilized hydrocarbon stream and a first hydrogen-containing vapor stream. After compression the hydrogen-containing vapor stream is passed to an absorption column wherein it is contacted with the first liquid hydrocarbon phase from the vapor-liquid equilibrium zone and stabilized reformate. A high purity hydrogen gas stream is recovered from the absorption zone with one portion being recycled back to the reaction zone and the balance being recovered for further use.

U.S. Pat. No. 4,364,820, issued Dec. 21, 1982, discloses a more complex method of recovering high purity hydrogen gas from a catalytic reforming reaction zone effluent. In this reference the reaction zone effluent is first separated in a vapor-liquid equilibrium zone into a first hydrogen-containing vapor phase and a first liquid hydrocarbon phase. One portion of the first hydrogen-containing vapor phase is compressed and recycled back to the catalytic reaction zone. The balance of the hydrogen-containing vapor phase is compressed and contacted with a second liquid hydrocarbon phase recovered from a hereinafter described third vapor-liquid equilibrium zone. The admixture is then passed to a second vapor-liquid equilibrium zone from which is derived a third liquid hydrocarbon phase comprising unstabilized reformate and a second hydrogen-containing vapor phase of higher purity than the first hydrogen-containing vapor phase derived from the first vapor-liquid equilibrium zone. The second hydrogen-containing vapor phase is subjected to compression and then contacted with the first liquid hydrocarbon phase from the first vapor-liquid equilibrium zone. The resulting admixture is then passed to a third vapor-liquid equilibrium zone from which is derived a hydrogen gas stream of high purity and the aforementioned second liquid hydrocarbon phase.

Recent U.S. Pat. No. 4,374,726, issued Feb. 22, 1983, discloses a further method of obtaining a high purity hydrogen gas stream from the reaction zone effluent of a catalytic reforming process. In this reference, the reaction zone effluent is passed to a vapor-liquid equilibrium zone to produce a first hydrocarbon liquid phase and a hydrogen-containing vapor phase. A first portion of the hydrogen-containing vapor phase is compressed and recycled to the catalytic reforming reaction zone. A second portion of the hydrogen-containing vapor phase is compressed and thereafter recontacted with the first liquid hydrocarbon phase from the vapor-liquid equilibrium zone. The resulting admixture is then passed to a second vapor-liquid equilibrium zone to produce a hydrogen gas stream of high purity and a second liquid hydrocarbon phase comprising unstabilized reformate.

In addition to the above-mentioned patent literature, the technical literature within the art has also disclosed methods for separating reaction zone effluents to obtain hydrogen-containing gas streams. For example, the Nov. 10, 1980 issue of the *Oil and Gas Journal* discloses an LPG dehydrogenation process in which the entire reaction zone effluent is first dried, then subjected to indirect heat exchange with a cool hydrogen-containing gas stream. The cool hydrogen-containing gas stream is derived by passing the entire cooled reaction zone effluent to a vapor-liquid equilibrium separation zone. The hydrogen-containing gas stream is removed from the separation zone and is then expanded. Thereafter it is subjected to indirect heat exchange with the entire reaction zone effluent. After the indirect heat exchange step, a portion of the hydrogen-containing vapor phase is recycled to the reaction zone.

In brief summation, the prior art which employs various vapor-liquid equilibrium separations, expansions, recontacting steps and/or absorption to produce high purity hydrogen streams or hydrogen-containing streams from reaction zone effluents of catalytic hydrocarbon conversion processes is not cognizant of the technique herein described which employs the vapor-liquid equilibrium separation, indirect heat exchange, and the expansion of vapor techniques herein described in order to produce a high purity hydrogen gas stream.

SUMMARY OF THE INVENTION

To reiterate briefly, the process encompassed by our inventive concept is suitable for use in hydrocarbon conversion reaction systems which may be characterized as single or multiple reaction zones in which catalyst particles are disposed as fixed beds or movable via gravity flow. Moreover, the present invention may be advantageously utilized in hydrocarbon conversion reaction systems which result in the net production or the net consumption of hydrogen. Although the following discussion is specifically directed toward catalytic reforming of naphtha boiling range fractions, there is no intent to so limit the present invention.

The art of catalytic reforming is well known to the petroleum refining and petrochemical processing industry. Accordingly, a detailed description thereof is not required herein. In brief, the catalytic reforming art is largely concerned with the treatment of a petroleum gasoline fraction to improve its anti-knock characteristics. The petroleum fraction may be a full boiling range gasoline fraction having an initial boiling point of from about 50° to about 100° F. and an end boiling point from about 325° to about 425° F. More frequently the gasoline fraction will have an initial boiling point of about 150° to about 250° F. and an end boiling point of from about 350° to 425° F., this higher boiling fraction being commonly referred to as naphtha. The reforming process is particularly applicable to the treatment of those straight run gasolines comprising relatively large concentrations of naphthenic and substantially straight chain paraffinic hydrocarbons which are amenable to aromatization through dehydrogenation and/or cyclization. Various other concomitant reactions also occur, such as isomerization and hydrogen transfer, which are beneficial in upgrading the anti-knock properties of the selected gasoline fraction. In addition to improving the anti-knock characteristics of the gasoline fraction, the tendency of the process to produce aromatics from naphthenic and paraffinic hydrocarbons makes catalytic reforming an invaluable source for the production of benzene, toluene, and xylenes all of great utility in the petrochemical industry.

Widely accepted catalysts for use in the reforming process typically comprise platinum on an alumina support. These catalysts will generally contain from about 0.05 to about 5 wt. % platinum. More recently, certain promoters or modifiers, such as cobalt, nickel, rhenium, germanium and tin, have been incorporated into the reforming catalyst to enhance its performance.

The catalytic reforming of naphtha boiling range hydrocarbons, a vapor phase operation, is effected at conversion conditions which include catalyst bed temperatures in the range of from about 700° to about 1020° F.; judicious and cautious techniques generally dictate that the catalyst temperatures not substantially exceed a level of about 1020° F. Other conditions generally include a pressure of from about 50 to about 1000 psig, a liquid hourly space velocity (defined as volumes of fresh charge stock per hour per volume of catalyst particles in the reaction zone) of from about 0.2 to about 10.0 $hr.^{-1}$ and a hydrogen to hydrocarbon mole ratio generally in the range of from about 0.5:1.0 to about 10.0:1.0. As those possessing the requisite skill in the petroleum refining art are aware, continuous regenerative reforming systems offer numerous advantages when compared to the fixed bed systems. Among these is the capability of efficient operation at comparatively lower pressures—e.g. 50 to about 200 psig—and higher liquid hourly space velocities—e.g. about 3.0 to about 10 $hr.^{-1}$. As a result of continuous catalyst regeneration, higher consistent inlet catalyst bed temperatures can be maintained—e.g. 950° to about 1010° F. Furthermore, there is afforded a corresponding increase in hydrogen production and hydrogen purity in the hydrogen-containing vaporous phase from the product separation facility.

The catalytic reforming reaction is carried out at the aforementioned reforming conditions in a reaction zone comprising either a fixed or a moving catalyst bed. Usually, the reaction zone will comprise a plurality of catalyst beds, commonly referred to as stages, and the catalyst beds may be stacked and enclosed within a single reactor vessel, or the catalyst beds may each be enclosed in a separate reactor vessel in a side-by-side reactor arrangement. Generally a reaction zone will comprise two to four catalyst beds in either the stacked and/or side-by-side configuration. The amount of catalyst used in each of the catalyst beds may be varied to compensate for the endothermic heat of reaction in each case. For example, in a three catalyst bed system, the first bed will generally contain from about 10 to about 30 vol. %; the second, from about 25 to about 45 vol. %; and the third, from about 40 to about 60 vol. %, all percentages being based on the amount of catalyst within the reaction zone. With respect to a four catalyst bed system, suitable catalyst loadings would be from about 5 to about 15 vol. % in the first bed, from about 15 to about 25 vol. % in the second, from about 25 to about 35 vol. % in the third and from about 35 to about 50 vol. % in the fourth. The reactant stream, comprising hydrogen and the hydrocarbon feed, should desirably flow serially through the reaction zones in order of increasing catalyst volume with interstage heating. The unequal catalyst distribution, increasing in the serial direction of reactant stream flow, facilitates and enhances the distribution of the reactions.

Upon removal of the hydrocarbon and hydrogen effluent from the catalytic reaction zone, it is customarily subjected to indirect heat exchange typically with the hydrogen and hydrocarbon feed to the catalytic reaction zone. Such an indirect heat exchange aids in the further processing of the reaction zone effluent by cooling it and recovers heat which would otherwise be lost for further use in the catalytic reforming process. Following any such cooling step which may be employed, the reaction zone effluent is passed to a vapor-liquid equilibrium zone to recover a hydrogen-containing vapor phase from the effluent, at least a portion of which is to be recycled back to the reforming zone. The vapor-liquid equilibrium zone is usually maintained at substantially the same pressure as employed in the reforming reaction zone, allowing for the pressure drop in the system. The temperature within the vapor-liquid equilibrium zone is typically maintained at about 60° to about 120° F. The temperature and pressure are selected in order to produce a hydrogen-containing vapor phase and a principally liquid phase comprising unstabilized reformate. The unstabilized reformate is then further treated in a fractionation column for the recovery of reformate product. In addition a fractionation column overhead product is recovered comprising light hydrocarbons which are generally gaseous at standard temperature and pressure and include $C_3$ and $C_4$ hydrocarbons.

One portion of the hydrogen-containing vapor phase is recycled to the catalytic reforming reaction zone while in accordance with the invention a second portion which may comprise the balance of the hydrogen-containing vapor phase is dried before cooling. Drying of the hydrogen-containing vapor phase is necessary because water, which may be intentionally injected into the reaction zone or which may comprise a reaction zone feed contaminant, must be substantially removed to avoid formation of ice upon cooling. By drying the hydrogen-containing vapor phase, formation of ice and the concomitant reduction of heat transfer coefficients in the heat exchanger apparatus utilized to effect the cooling are avoided. The drying may be effected by any means known in the art. Absorption using liquid desiccants such as ethylene glycol, diethylene glycol and triethylene glycol may be advantageously employed. In such an absorption system a glycol desiccant is contacted with the hydrogen-containing vapor phase in an absorber column. Water-rich glycol is then removed from the absorber and passed to a regenerator wherein the water is removed from the glycol desiccant by application of heat. The resulting lean glycol desiccant is then recycled to the absorber column for further use. As an alternative to absorption using liquid desiccants, drying may also be effected by adsorption utilizing a solid desiccant. Alumina, silica-gel, silica-alumina beads, and molecular sieves are typical of the solid desiccants which may be employed. Generally the solid desiccant will be emplaced in at least two beds in parallel flow configuration. While the hydrogen-containing vapor phase is passed through one bed of desiccant, the remaining bed or beds are regenerated. Regeneration is generally effected by heating to remove desorbed water and purging the desorbed water vapor from the desiccant bed. The beds of desiccant may, therefore, be cyclically alternated between drying and regeneration to provide continuous removal of water from the hydrogen-containing vapor phase.

Regardless of the exact method employed to effect the removal of water, after drying the hydrogen-containing vapor phase is subjected to an indirect heat exchange in order to remove heat from the hydrogen-containing vapor phase to effect condensation therefrom of light hydrocarbons, principally $C_3+$ hydrocarbons. As will be explained hereinafter more fully, because the noncondensed portion of the hydrogen-containing vapor phase, comprising principally hydrogen, is subjected to an expansion and then utilized as the cooling medium in the indirect heat exchange step, substantial amounts of heat may be removed from the hydrogen-containing vapor phase and the temperature thereof may be greatly reduced provided sufficient heat transfer surface is available within the heat transfer apparatus used to effect the indirect heat exchange.

Following cooling the hydrogen-containing vapor phase is separated in a second vapor-liquid equilibrium separation zone to provide a hydrogen-rich gas stream and a liquid stream, comprising $C_3+$ hydrocarbons. The pressure maintained in the second vapor-liquid equilibrium separation zone is substantially the same as that maintained in the first vapor-liquid equilibrium separation zone allowing for pressure drop through the drying apparatus, the heat exchange apparatus and associated piping. The temperature within the second vapor-liquid separation zone is substantially that of the hydrogen-containing vapor phase upon exit from the heat exchange apparatus which is dependent on the heat transfer surface area for a given pressure reduction ratio across the means utilized to effect the expansion of the hydrogen-rich gas stream.

Upon withdrawal from the second vapor-liquid equilibrium separation zone, the liquid stream, comprising $C_3+$ hydrocarbons, may be sent to the reformate stabilizer column if desired or subjected to any other processing step for the advantageous use thereof.

The hydrogen-rich gas stream is recovered from the second vapor-liquid equilibrium zone and is then subjected to an expansion in order to decrease the temperature thereof. Pursuant to one of the aforesaid objects of the invention, it is essential that the expansion be effected in such a manner as to produce work by recovery of energy from the hydrogen-rich vapor gas stream. Accordingly the expansion is preferabaly effected by use of a turboexpander means. The turboexpander means may in turn be connected to a shaft which may be employed to drive one or more pieces of equipment. For example the shaft may be connected to an electrical power generation means for the production of electrical power. The electricity so generated may be used to drive pumps, compressors, etc. If desired the electricity may be passed into a power grid system for use elsewhere in the refinery or petrochemical complex or for sale to electrical utilities. Alternatively the shaft may be utilized to directly provide shaft power for driving compressors, pumps or other pieces of process equipment.

As indicated previously, extremely cold temperatures may be achieved in subjecting the hydrogen-containing vapor phase to indirect heat exchange with the hydrogen-rich gas stream providing there is sufficient heat transfer surface in the heat transfer apparatus and a sufficient expansion pressure ratio across the turboexpander means. The greater the heat transfer surface area in the heat transfer apparatus, the more heat may be transferred from the hydrogen-containing vapor phase to the cooled hydrogen-rich gas stream. Moreover, as heat is transferred from the hydrogen-containing vapor phase and its temperature is reduced, the cooler the resulting hydrogen-rich gas stream will be prior to expansion and in turn, the cooler the expanded hydrogen-rich gas stream will become. Accordingly by increasing the heat transfer surface in the heat transfer apparatus, a hydrogen-rich gas stream of greater purity may be obtained. However, it should be remembered that heat energy transferred from the hydrogen-containing vapor phase to the hydrogen-rich gas stream in the heat exchange apparatus will be unavailable for recovery by the turboexpander means and hence the amount of available shaft power will be reduced.

To more fully demonstrate the attendent advantages of the present invention, the following example, based on engineering calculations, is set forth.

BRIEF DESCRIPTION OF THE DRAWING

In further describing the present inventive concept, reference will be made to the accompanying drawing which serves to illustrate one or more embodiments thereof.

Although the drawing depicts a catalytic reforming process, as previously indicated there is no intent to so limit the present invention which has broad application to hydrocarbon conversion processes. The FIGURE in the drawing depicts a simplified schematic flow diagram of a catalytic reforming process in accordance with the present invention in which only principal pieces of equipment are shown. These are a catalytic reaction zone 6 and a first vapor-liquid equilibrium separation zone 8. Compressor 12 is utilized for vapor recycle and mole sieve dryers 16 and 17 are employed for drying vapor. Heat exchanger 19, second vapor-liquid equilibrium separation zone 21 and expansion turbine 24 comprise a cooling system. Electrical generator 26 provides electricity for either compressor motor 29 or power grid 32. Details such as pumps, heaters and coolers, condensers, miscellaneous heat exchangers, startup lines, valving and similar hardware have been omitted as being non-essential to a clear understanding of the techniques involved. The utilization of such appurtenances, to modify the illustrated process, is well within the purview of one skilled in the art, and will not remove the resulting process beyond the scope and spirit of the appended claims.

DETAILED DESCRIPTION OF THE DRAWING

Specifically referring now to the drawing, a naphtha boiling range hydrocarbon charge stock is introduced via line 1 and mixed with a hydrogen-containing vapor phase recycled via line 2. The admixture is then passed through line 3 into fired heater 4 wherein it is brought up to a reaction zone inlet temperature of about 950° F.

After heating, the naphtha-hydrogen admixture is passed through line 5 to a reaction zone 6 which has emplaced therein a reforming catalyst comprising platinum on alumina. Reaction zone 6 has been depicted here as a single zone for convenience; however, as previously noted generally the reaction will comprise two or more catalyst beds in series with inter-catalyst bed heating either in heater 4 or in separate heaters.

Regardless of the exact configuration of the reaction zone, the effluent therefrom is cooled (via heat exchange with the feed and via externally cooled heat exchangers which are not depicted) and passed via line 7 into first vapor-liquid equilibrium separation zone 8 which is maintained at a temperature of 100° F. and a pressure of 250 psig. A liquid hydrocarbon stream comprising an unstabilized naphtha containing dissolved hydrogen, $C_1$ and $C_4$ light hydrocarbons is withdrawn via line 9 for passage to a stabilizing column. A hydrogen-containing vapor phase comprising in mol. % on a water-free basis 82.1% $H_2$, 6.1% $C_1$, 5.2% $C_2$ and 6.6% $C_3$+ is withdrawn from the first vapor-liquid equilibrium separation zone 8 through line 10.

A first portion of the hydrogen-containing vapor phase sufficient to provide a hydrogen to hydrocarbon mole ratio of about 7.0 is passed to compressor 12 via line 11 wherein it is compressed and recycled through line 2 for admixture with the naphtha boiling range charge stock. The remaining portion of hydrogen-containing vapor phase is sent for drying via line 13.

In this instance the hydrogen-containing vapor phase is dried in mole sieve dryers 16 and 17; however, as noted previously, a glycol absorption system or other suitable dryer system could be employed in place of the mole sieve dryers. Here the flow of hydrogen-containing vapor phase is directed through dryer 16 and block valves **14*a* and 14*b* are opened. Dryer 17 is undergoing regeneration (the regeneration equipment and lines are not depicted for simplicity) and block valves 15*a* and 15*b*** remain closed.

The resulting dried hydrogen-containing vapor phase is passed through line 18 to heat exchanger 19 wherein it is subjected to indirect heat exchange with a cool hydrogen-rich gas stream from line 33. As indicated previously, the amount of heat transferred in exchanger 19 is dependent on the heat transfer surface area. In this instance, exchanger 19 has a heat transfer surface area of about 1114 ft.$^2$ and as a result, the hydrogen-containing vapor phase is cooled to a temperature of about 0° F.

After cooling, the hydrogen-containing vapor phase leaves heat exchanger 19 via line 20 and is separated in second vapor-liquid equilibrium separation zone 21 into a liquid phase comprising $C_1$+ hydrocarbons and a hydrogen-rich gas stream comprising on a mol. % basis about 85% $H_2$, 6.1% $C_1$, 5.1% $C_2$ and 3.8% $C_3$+. The second vapor-liquid equilibrium separation zone is maintained at a pressure of about 245 psig and a temperature of about 0° F. Although the hydrogen purity is improved from about 82% in the hydrogen-containing vapor phase to about 85% in the hydrogen-rich gas stream, the amount of liquid recovered from the second vapor-liquid equilibrium separation zone may be significant. For example, in the present instance, a flow rate of 61,590.6 lbs/hr of hydrogen-containing vapor phase results in a recovery of about 15,089.3 lbs/hr of liquid comprising $C_1$+ hydrocarbons and trace amounts of dissolved hydrogen. Thus substantial amounts of valuable hydrocarbon products are recovered in addition to obtaining a gas stream of increased hydrogen purity.

The liquid hydrocarbon stream is withdrawn from second vapor-liquid equilibrium separation zone 21 via line 22 and may be sent to the reformer stabilizer column or other suitable unit operation for further processing. The hydrogen-rich gas stream is removed from second vapor-liquid equilibrium separation zone 21 via line 23 through which it is passed to the inlet of turboexpander means 24. In this example the hydrogen-rich gas stream is to be passed to the refinery fuel system. The pressure of such a system is typically 50 psig. Accordingly the turboexpander 24 inlet temperature is about 0° F. and the inlet pressure is about 245 psig. The expander 24 outlet pressure is 55 psig and expander 24 is assumed to have an 85% isentropic efficiency. Accordingly then, the temperature of the hydrogen-rich gas stream at the expander outlet is −102° F. The now cool hydrogen-rich gas stream is passed via line 33 to heat exchanger 19 wherein it is subjected to the aforementioned indirect heat exchange with the hydrogen-containing vapor phase from line 18. Upon. leaving heat exchanger 19, the hydrogen-rich gas stream is passed to the fuel system via line 34.

As a result of expanding the hydrogen-rich gas stream in the turboexpander 24, about 2600 Hp of shaft power is available via shaft 25 to electric generator 26. Electric power from generator 26 may in turn be passed via electrical lines 27 and 28 to compressor motor 29 where it is utilized to drive shaft 30 and compressor 12. Alternatively or if excess electric power is available, it may be passed via lines 27 and 31 to the refinery power grid 32 depicted herein as a box for use elsewhere or for sale to a local electric utility.

As noted previously by increasing the heat transfer surface area in exchanger 19, more heat exchange may take place and, correspondingly, more hydrocarbon liquid may be recovered from vapor-liquid equilibrium separation zone 21. Thus if heat exchanger 19 has 3486 ft.$^2$ of heat transfer area, a 61,590.6 lbs/hr hydrogen-containing vapor phase may be cooled to a temperature of −50° F. and 24,588.7 lbs/hr of liquid hydrocarbon may be recovered from vapor-liquid equilibrium separation zone 21. The hydrogen-rich gas stream will have a hydrogen purity of about 87 mol. % and a temperature at the expander 24 outlet of about −147° F.; however, only about 1900 Hp of shaft power will be available from expander 24. The limiting case of course would be an infinite heat exchange surface in exchanger 19. As the heat transfer area approaches infinity, the temperature of the hydrogen-containing vapor phase from exchanger 19 approaches −100° F. For a hydrogen-containing vapor phase rate of 61,590.6 lbs/hr, the amount of hydrocarbon liquid recovered from separator 21 approaches 33,349.1 lbs/hr and the hydrogen purity of the hydrogen-rich gas stream approaches 90 mol. %.

However the shaft power extracted by expander 24 approaches 1100 Hp.

Accordingly it can be seen from the above that extremely low temperatures may be achieved and in turn that hydrogen-rich gas streams of improved purity may be obtained along with the concomitant recovery of energy by means of the present invention.

We claim as our invention:

1. A process to provide a purified hydrogen-rich gas stream and to maximize recovery of $C_3+$ hydrocarbons from a catalytic hydrocarbon conversion reaction effluent containing hydrogen and hydrocarbons by treating said effluent from a catalytic hydrocarbon conversion reaction zone comprising the steps of:

(a) passing said catalytic hydrocarbon conversion reaction effluent containing hydrogen and hydrocarbons to a first vapor-liquid equilibrium zone, recovering therefrom a hydrogen-containing vapor phase and recycling a first portion thereof to said hydrocarbon conversion reaction zone;

(b) drying at least a second portion of the hydrogen-containing vapor phase by removing water therefrom and thereafter cooling the dried portion by indirect heat exchange with a hereinafter defined hydrogen-rich gas stream;

(c) passing the dried, cooled portion of the hydrogen-containing vapor phase to a second vapor-liquid equilibrium separation zone to produce a liquid stream comprising $C_3+$ light hydrocarbons, which are recovered from said process, and a purified hydrogen-rich gas stream;

(d) expanding at least a portion of said purified hydrogen-rich gas stream and thereafter subjecting it to indirect heat exchange with the dried portion of the hydrogen-containing vapor phase pursuant to step (b) above; and, (e) recovering said heat exchanged purified hydrogen-rich gas stream.

2. The process of claim 1 wherein the expansion of said portion of the hydrogen-rich gas stream is effecied by use of a turboexpander means.

3. The process of claim 2 wherein the turboexpander means is connected to a shaft for the production of shaft power.

4. The process of claim 3 wherein the shaft is connected to electrical power generation means and the shaft power is utilized for the production of electrical power.

5. The process of claim 4 wherein at least a portion of the electrical power produced is passed to a power grid system.

6. The process of claim 4 wherein at least a portion of the electrical power produced is utilized to drive a compressor means for the compression of a second portion of the first hydrogen-containing vapor phase.

7. The process of claim 3 wherein at least a portion of the shaft power produced is utilized to drive a compressor means for the recycling of said first portion of the hydrogen-containing vapor phase.

8. The process of claim 1 further characterized in that the catalytic hydrocarbon conversion reaction zone is a catalytic reforming reaction zone.

9. The process of claim 1 further characterized in that the catalytic hydrocarbon conversion reaction zone is a dehydrogenation reaction zone.

10. A process to produce a purified hydrogen rich gas stream and to maximize recovery of $C_3+$ hydrocarbons from a catalytic hydrocarbon reforming effluent containing hydrogen and hydrocarbons by treating said effluent from a catalyst reforming reaction zone comprising the steps of:

(a) passing said effluent to a first vapor-liquid equilibrium zone and recovering therefrom a hydrogen-containing vapor phase;

(b) subjecting a first portion of the hydrogen-containing vapor phase to compression and recycling at least part of the compressed first portion to the catalytic reforming reaction zone;

(c) drying a second portion of the hydrogen-containing vapor phase by removing water therefrom and thereafter cooling the dried portion by indirect heat exchange with a hereinafter defined purified hydrogen-rich gas stream;

(d) passing the dried, cooled portion of the hydrogen-containing vapor phase to a second vapor-liquid equilibrium separation zone to produce a liquid stream comprising $C_3+$ light hydrocarbons, which are recovered from said process, and a purified hydrogen-rich gas stream;

(e) subjecting at least a portion of said purified hydrogen-rich gas stream to an expansion and thereafter subjecting it to indirect heat exchange with the dried second portion of the hydrogen-containing vapor phase pursuant to step (c) above, and effecting the compression in step (b) above at least in part with energy resulting from said expansion of a portion of said purified hydrogen-rich gas stream; and, (f) recovering said heat exchanged purified hydrogen-rich gas stream.

* * * * *